US010945464B2

(12) United States Patent
Daryani et al.

(10) Patent No.: US 10,945,464 B2
(45) Date of Patent: Mar. 16, 2021

(54) ELECTRONIC SMOKING DEVICE WITH A VARIABLE-VOLUME LIQUID RESERVOIR

(71) Applicant: Fontem Holdings 1 B.V., Amsterdam (NL)

(72) Inventors: Neha Daryani, Hamburg (DE); Lutz Deichmann, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 16 days.

(21) Appl. No.: 15/771,081

(22) PCT Filed: Oct. 28, 2016

(86) PCT No.: PCT/EP2016/076034
§ 371 (c)(1),
(2) Date: Apr. 25, 2018

(87) PCT Pub. No.: WO2017/072277
PCT Pub. Date: May 4, 2017

(65) Prior Publication Data

US 2018/0249762 A1 Sep. 6, 2018

(30) Foreign Application Priority Data

Oct. 28, 2015 (EP) ..... 15191940

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 5,785,688 | A * | 7/1998 | Joshi | A61M 5/14593 604/132 |
| 2008/0257915 | A1* | 10/2008 | Wold | B05B 11/025 222/389 |
| 2013/0199528 | A1* | 8/2013 | Goodman | A24F 47/008 128/203.26 |
| 2015/0027456 | A1* | 1/2015 | Janardhan | A24F 47/008 131/328 |
| 2015/0272216 | A1* | 10/2015 | Dai | A61M 15/06 131/328 |

(Continued)

FOREIGN PATENT DOCUMENTS

| | | | |
|---|---|---|---|
| CA | 2814977 | A1 | 5/2012 |
| CN | 103917119 | A | 7/2014 |
| CN | 104136123 | A | 11/2014 |

(Continued)

*Primary Examiner* — Eric Yaary
*Assistant Examiner* — Jennifer A Kessie
(74) *Attorney, Agent, or Firm* — Dykema Gossett PLLC

(57) ABSTRACT

There is provided an electronic smoking device (10; 110; 210; 310) comprising a power supply (18), a liquid reservoir (34; 34; 234; 334) storing a liquid, and an atomizer (26). The atomizer (26) is adapted to atomize the liquid stored in the liquid reservoir (34; 34; 234; 334) when operated by the power supply (18). The liquid reservoir (34; 34; 234; 334) comprises a first chamber (40) storing the liquid, which first chamber (40) has a variable volume that is reducible and non-increasable.

10 Claims, 5 Drawing Sheets

(56) References Cited

U.S. PATENT DOCUMENTS

| | | | | |
|---|---|---|---|---|
| 2016/0021931 | A1* | 1/2016 | Hawes | A24F 47/008 131/328 |
| 2016/0150824 | A1 | 6/2016 | Memari et al. | |

FOREIGN PATENT DOCUMENTS

| | | | |
|---|---|---|---|
| EP | 1 618 803 | A1 | 1/2006 |
| KR | 20130013472 | A | 2/2013 |
| WO | 2000/50111 | A1 | 8/2000 |
| WO | 2006124448 | A2 | 11/2006 |
| WO | 2013148810 | A1 | 10/2013 |
| WO | 2014093127 | A4 | 6/2014 |
| WO | 2014/153515 | A1 | 9/2014 |

* cited by examiner

ELECTRONIC SMOKING DEVICE WITH A VARIABLE-VOLUME LIQUID RESERVOIR

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

It is known that the joy of consumption of an electronic smoking device can be increased when liquid contained within the liquid reservoir is directly provided onto a heating element of the atomizer, e.g. onto a heating coil. Such a direct provision of liquid enhances the vapor production and the taste of the aerosol generated by the atomizer. However, such a direct application of the liquid has to be manually performed, using a pipette or an equivalent thereof, prior to consumption while the electronic smoking device needs to be disassembled.

SUMMARY OF THE INVENTION

In accordance with one aspect of the present invention there is provided an electronic smoking device comprising a power supply, a liquid reservoir storing a liquid, and an atomizer. The atomizer is adapted to atomize the liquid stored in the liquid reservoir when operated by the power supply. The liquid reservoir comprises a first chamber storing the liquid, which first chamber has a variable volume that is reducible and non-increasable.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
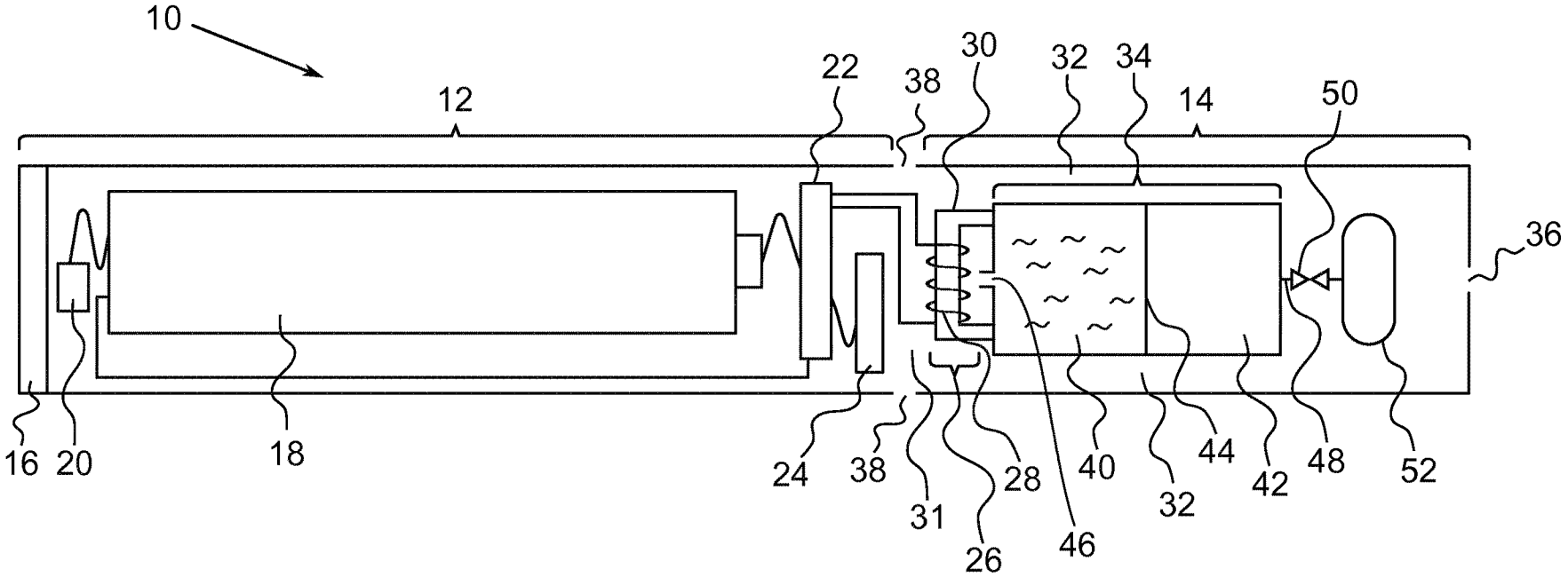
FIG. 1 is a schematic cross-sectional illustration of an exemplary e-cigarette.

Throughout the following, an electronic smoking device will be exemplarily described with reference to an e-cigarette. As is shown in FIG. 1, an electronic smoking device 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow an LED 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A battery 18, a light-emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending in an atomizing chamber 31 that communicates with air flow passages 32 of the atomizer/liquid reservoir portion 14. The coil 28 may be positioned anywhere in the atomizer 26 and may be transverse or parallel to the liquid reservoir 34. The wick 30 and heating coil 28 do not completely block the atomizing chamber 31. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The air flow passages 32 surround a centrally arranged cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid with the ends of the wick 30 abutting the wadding. In other embodiments the liquid reservoir 34 may comprise a toroidal cavity arranged to be filled with liquid and with the ends of the wick 30 extending into the toroidal cavity.

The liquid reservoir 34 comprises first chamber 40 storing the liquid. The first chamber 40 has a variable volume that is reducible and non-increasable. The first chamber 40 communicates with an outlet opening 46 that is arranged adjacent to the atomizer 26. According to this arrangement, liquid can be supplied directly to the heating element 28 from the liquid reservoir 34 through the outlet opening 46. The outlet opening is configured to let pass liquid when the pressure in the first chamber 40 exceeds a predetermined threshold value. The liquid reservoir further comprises a second chamber 42, which is separated from the first chamber 40 by means of a sheet of flexible expandable material. The second chamber 42 communicates with an inlet opening and can be filled with a fluid provided through the inlet opening 48. Pressurized fluid can be provided from a pressure source 52 via a unidirectional valve 50. The above-sketched setup easily allows for controlled direct supply of liquid to the heating element 28, as described below in detail with reference to FIG. 2A, 2B.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the electronic smoking device 10. This causes air to be drawn into the electronic smoking device 10 via one or more air inlets, such as air inlets 38, and to be drawn through the atomizing chamber 31 and the air flow passages 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the atomizing chamber 31. As the user continues to suck on the electronic smoking device 10, this aerosol is drawn through the air flow passages 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34, after which the electronic smoking device 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the electronic smoking device 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having air flow passages 32 through which a user inhales aerosol. In other embodiments, aerosol may flow through a central passage extending through a toroidal liquid reservoir in the cartridge to an air inhalation port 36.

Of course, in addition to the above description of the structure and function of a typical electronic smoking device 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2A:
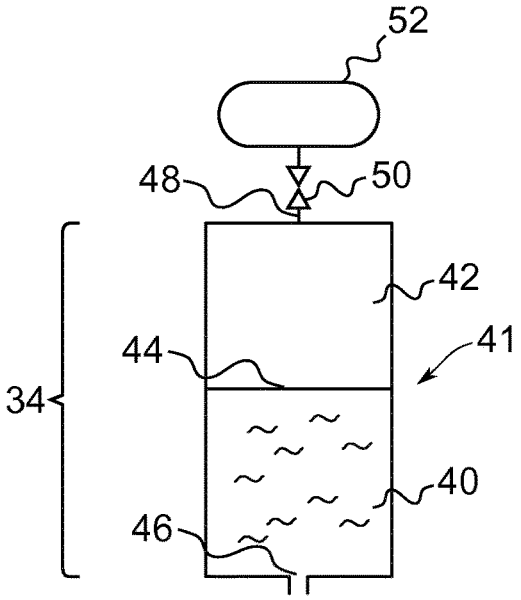
FIGS. 2A and 2B illustrate a cross-sectional view of a liquid reservoir with variable volume according to a first embodiment.
Figure 2B:
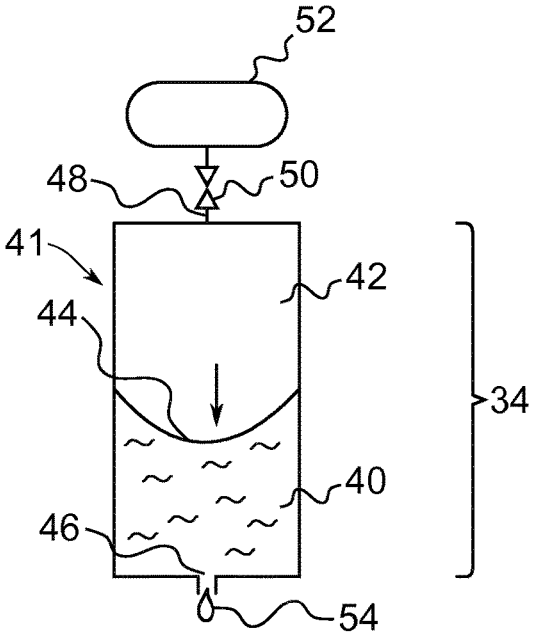

In FIGS. 2A and 2B, the liquid reservoir 34 of the electronic smoking device 10 of FIG. 1 is shown in a cross-sectional view together with the pressure source 52 connected to the second chamber 42 of the liquid reservoir 34 via the inlet opening 48. These figures serve to illustrate a process of directly suppling, in a controlled manner, liquid to the atomizer 26 (cf. FIG. 1) through the outlet opening 46 of the first chamber 40 of the liquid reservoir 34, which first chamber 40 stores the liquid.

The liquid reservoir 34 comprises a fixed volume rigid tank 41 including the first chamber 40 and the second chamber 42. The first chamber 40 and the second chamber 42 are separated by the flexible, expandable sheet 44 that is arranged inside the tank 41. The sheet is impermeable to the liquid in the first chamber 40 and to a fluid existing in the second chamber 42.

The volume of the first chamber 40 is controlled by the adaptable volume of the second chamber 42, due to the fixed volume of the rigid tank 41. The volume of the second chamber 42 in turn is controlled by the pressure level existing in the second chamber 42, which pressure level can be increased by filling pressurized fluid into the second chamber 42 through the inlet opening 48. Between the inlet opening 48 and the pressure source 52, which supplies pressurized fluid, a unidirectional valve 50 is arranged, which prevents fluid from being discharged from the second chamber 42. In other words, the pressure level in the second chamber 42 can only be deceased by increasing the volume of the second chamber 42. In the state illustrated in FIG. 2A, the pressure level in the second chamber 42 is such that an expansion of the sheet 44 into the volume of the second chamber 42 is avoided. In other words, an increase of the volume of the first chamber 40 is prevented by the pressure level existing in the second chamber 42.

By operating the pressure source 52, pressurized fluid is filled into the second chamber 42, thereby increasing the pressure in the second chamber 42. The increased pressure in the second chamber 42, via the flexible expandable sheet 44, results in an increased pressure also in the first chamber 40. As soon as the pressure level in the first chamber 40 exceeds a predetermined threshold value, liquid 54 passes through the outlet opening 46 of the first chamber 40, as illustrated in FIG. 2B. As a result, the volume of the first chamber 40 decreases and the volume of the second chamber 42 increases due to a respective expansion of the sheet 44. At the same time, the pressure level in the first chamber 40 falls below the predetermined threshold value, given that no further pressurized fluid is filled into the second chamber 42. In other words, direct supply of liquid to the heating element 28 of the atomizer 26 through the outlet opening 46 can be controlled by pressure only, without any holding material. Delivery of liquid is thus in particular independent from a direction of the liquid reservoir. The fact that the volume of the first chamber 40 that stores the liquid only decreases ensures controlled supply of liquid irrespective of the filling level of the first chamber 40.

The pressure source 52 can be operated by a user of the electronic smoking device 10, in order to directly supply liquid to the heating element 28 of the atomizer. The pressure source 52 can be operated manually by the user; e.g. in case the pressure source 52 is formed as a pump which can be operated by the user by pressing a button that is operatively connected with the pump. According to another variant, the pressure source can contain pressurized fluid, which fluid can be filled into the second chamber 42 by a user opening the valve 50 in a controlled manner. In other words, the pressure source 52 together with the valve 50 can form part of a volume modifying unit that is configured to be operated by a user of the electronic smoking device 10 in order to reduce the volume of the first chamber 40, i.e. to directly supply liquid from the first chamber 40 of the liquid reservoir 34 through the outlet opening 46.

There is also the possibility to operate the valve 50 or the pressure source 52 by means of the control electronics 22, e.g. based on puffs counted by a puff counter implemented in the control electronics 22, so that liquid can automatically be supplied to the heating element, say, any 10 to 50 puffs.

Figure 3A:
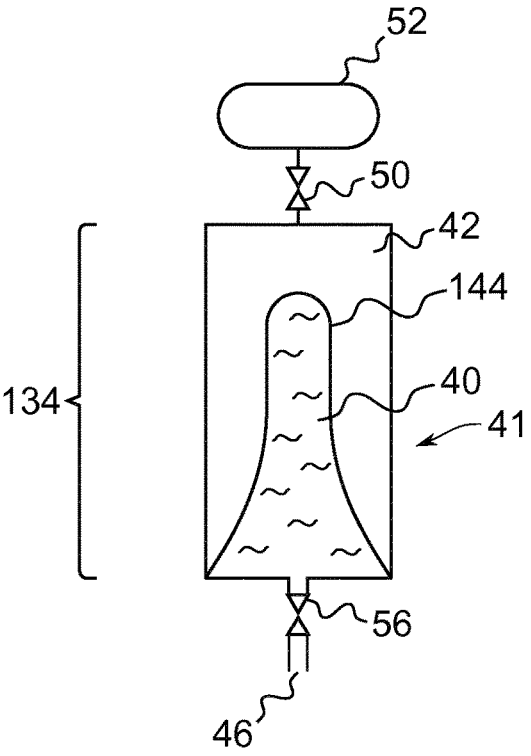
FIGS. 3A and 3B illustrate a cross-sectional view of a liquid reservoir with variable volume according to a second embodiment.
Figure 3B:
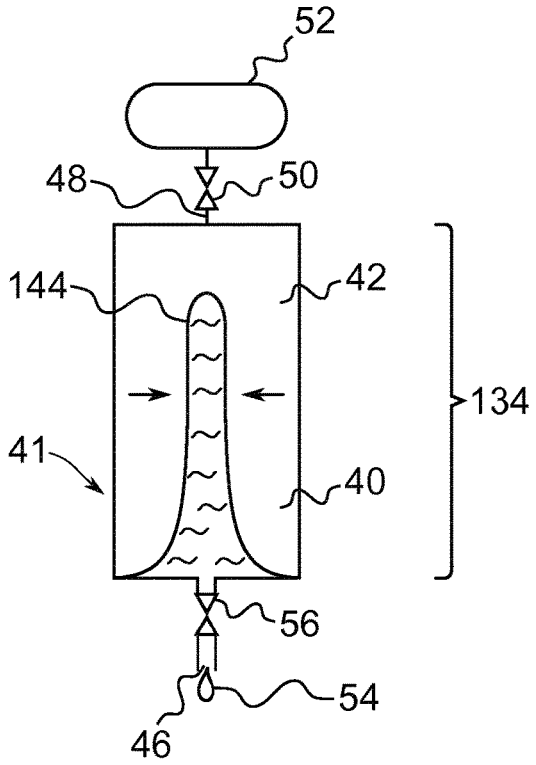

FIGS. 3A and 3B show a cross-sectional illustration of a liquid reservoir 134 according to a second embodiment. In contrast to the embodiment of FIG. 2A, 2B, the first chamber 40 storing the liquid is at least partially formed as a bladder 144 of flexible, but non-expandable material. In order to supply liquid through the outlet opening 46, the bladder 144 is squeezed by increasing the pressure level in the second chamber 42, as described in detail with reference to FIG. 2A, 2B.

As shown in FIG. 3A, 3B, the outlet opening 46 communicates with a unidirectional valve 56. This valve 56, on the one hand, can define the above mentioned threshold value that must be exceeded so that liquid passes the valve 56 and the outlet opening 46. On the other hand, the valve 56 can prevent air entering into the first chamber 40 through the outlet opening 46. Of course, the valve 56 can also be used in combination with the embodiment of FIG. 1, 2A, 2B.

Figure 4:
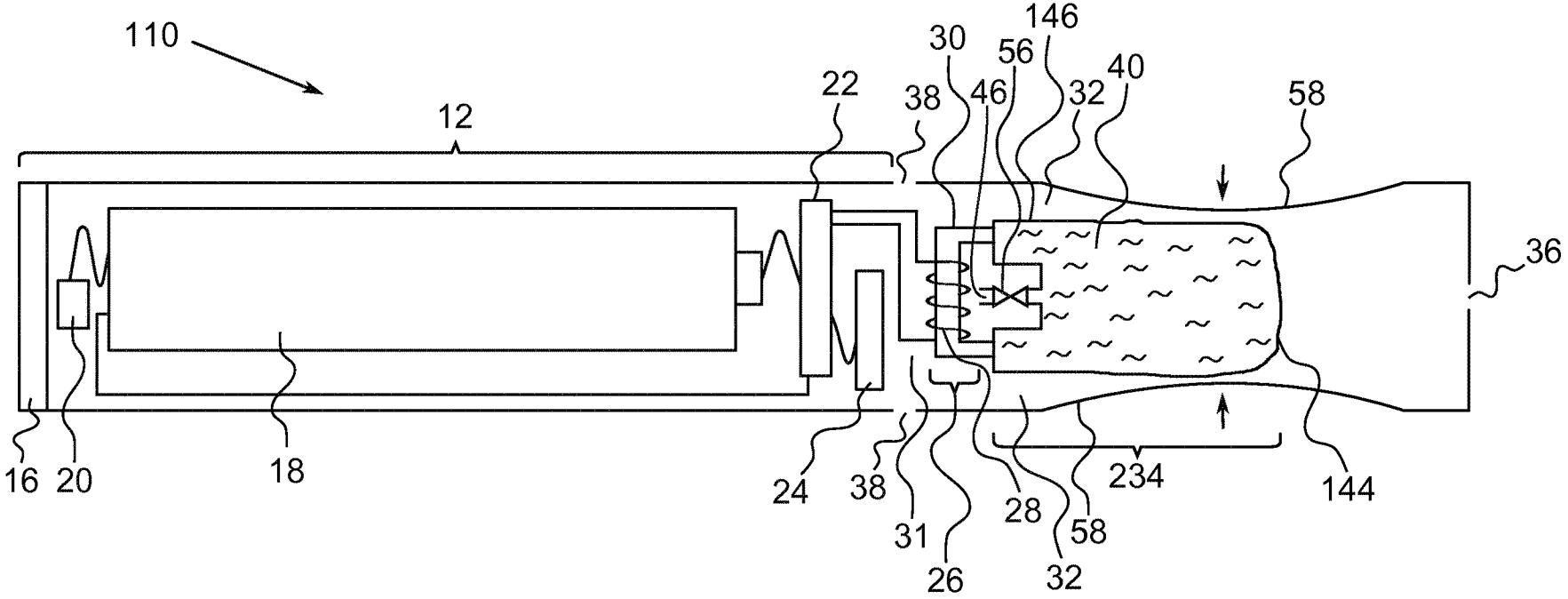
FIG. 4 is a schematic cross-sectional illustration of an e-cigarette according to a second embodiment.

In FIG. 4, an electronic smoking device 110 according to a second embodiment is show in a cross-sectional view. In contrast to the embodiments according to FIGS. 1 to 3, the liquid reservoir 234 is essentially formed by a bladder 144 of flexible, non-expandable material, together with a rigid base portion 146, which is in communication with the wick 30. The bladder 144 together with the rigid portion 146 includes the first chamber 40. There is no second chamber with respect to the liquid reservoir 234. In order to supply liquid to the heating element 28 of the atomizer 26, a user of the electronic smoking device 110 can manually squeeze the bladder 144. To that end, flexible resilient portions 58 are arranged in the side walls of the atomizer/liquid reservoir portion which can be depressed, as indicated by the arrows in FIG. 4. Due to the fact that no air can enter the bladder 144 through the output opening 46 and the fact that the bladder 144 is of non-expandable material, the volume of the first chamber 40 can only decrease. Liquid can easily and in a controlled manner by provided to the heating coil 28 by pressure, namely by a user manually squeezing the bladder 144.

Figures 5A, 5B, 5C:
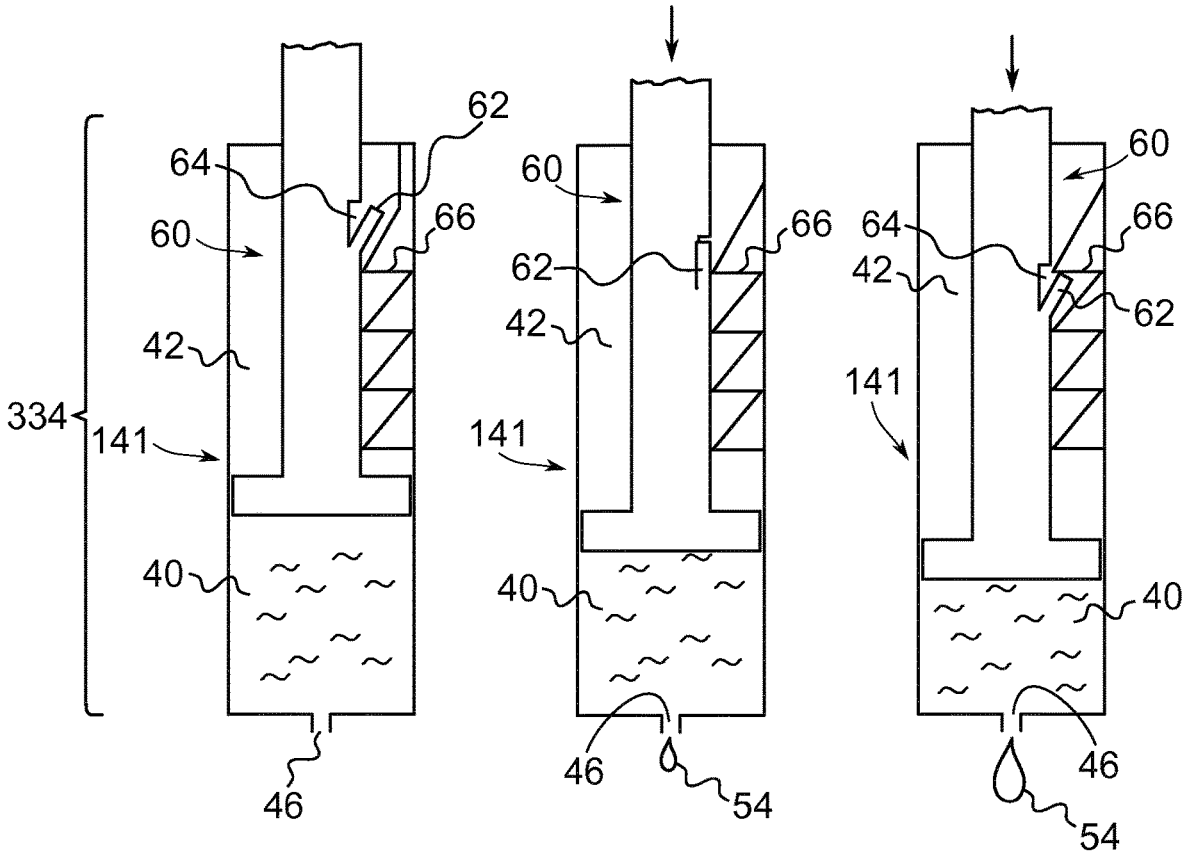
FIGS. 5A to 5C illustrate a cross-sectional view of a liquid reservoir with variable volume according to a third embodiment.

FIGS. 5A to 5C illustrate a further alternative embodiment of a liquid reservoir 324 having a first chamber 40 with a variable reducible and non-increasable volume in a cross-sectional view. The liquid reservoir 324 comprises a rigid hollow cylindrical body 141, corresponding to a fixed volume tank, and includes a first chamber 40 storing the liquid. The liquid reservoir 324 further includes a piston 60 that is sealingly inserted into an open end of the hollow cylindrical body 141. The piston 60 is configured to be moved into the hollow cylindrical body 141 (as indicated by the arrow in FIG. 5B, 5C), thereby increasing the pressure level in the first chamber 40 to obtain a value above the predetermined threshold. As a consequence, liquid 54 is supplied through the output opening 46 and the volume of the first chamber 40 is reduced (cf. FIG. 5A to 5C).

The portion of the hollow cylinder 141 that is occupied by the piston 60 corresponds to a second chamber 42. The piston 60 is mechanically connected with a blocking unit 62, 64, 66 that is configured to essentially prevent movement of the piston 60 out of the cylindrical hollow body. Thus, the volume of the second chamber 42 can only be increased and the volume of the first chamber 40 necessarily only decreases. The blocking unit comprises a stepped portion 66 on an inner wall of the cylindrical hollow body 141, which stepped portion engages with a spring-biased blocking element 62 that protrudes from the rod of the piston 60. The piston 60 can be moved into the cylindrical hollow body 141, because the blocking element 62 can be received by a respective recess 64 when the piston 60 is moved forward. However, a movement of the piston 60 in the opposite direction is prevented by the blocking element 62 engaging the stepped portion 66, as can be seen in FIG. 5C.

Figure 6A:
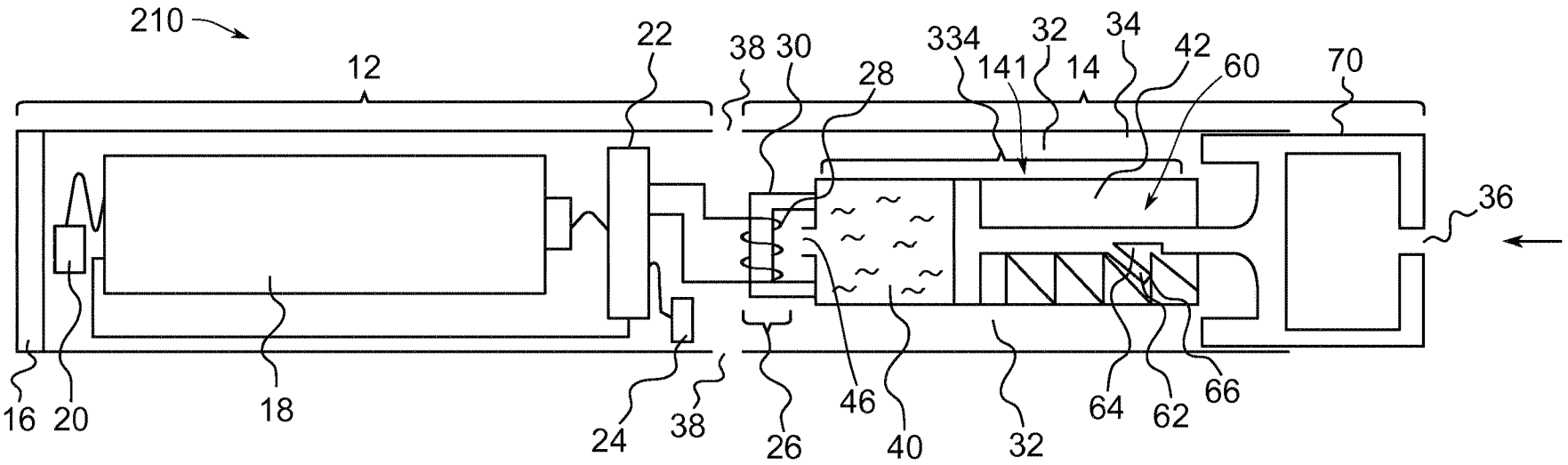
FIG. 6A is a schematic cross-sectional illustration of an e-cigarette according to a third embodiment.
Figure 6B:
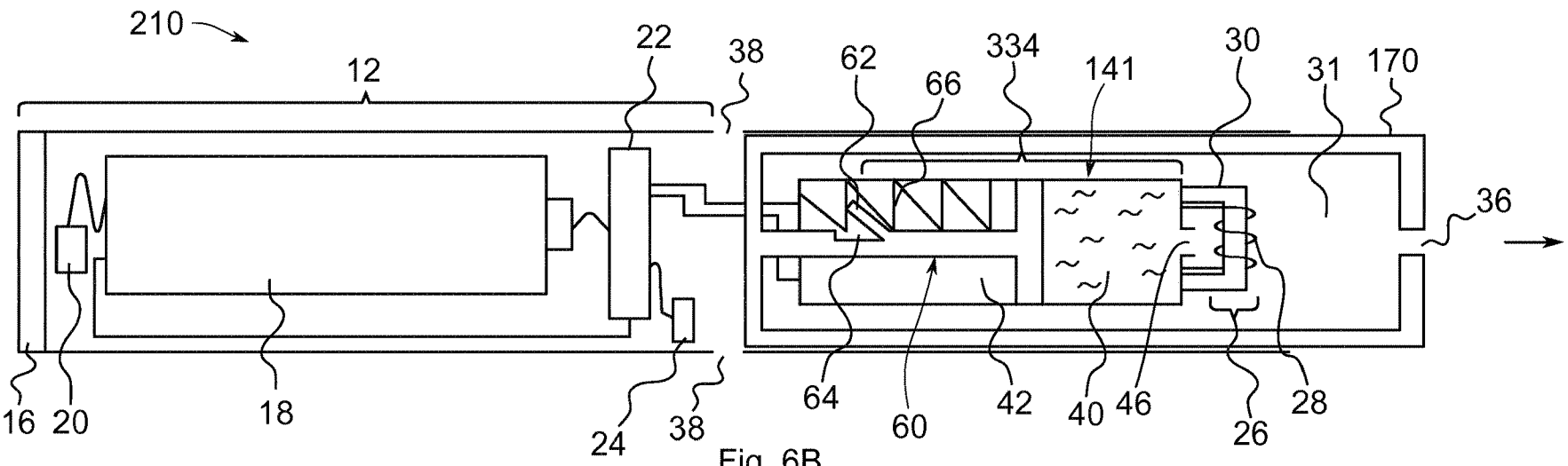
FIG. 6B is a schematic cross-sectional illustration of an e-cigarette according to a fourth embodiment.

In FIGS. 6A and 6B two alternative embodiments of electronic smoking devices 210, 310 are illustrated in cross-sectional view, which both include a liquid reservoir 324 as described above with respect to FIG. 5A to 5C.

As shown in FIG. 6A, movement of the piston 60 into the cylindrical hollow body 141 can be achieved by simply pushing the piston 60 into the respective direction (indicated by the arrow in FIG. 6A), e.g. by a user of the electronic smoking device 210. To that end, the piston 60 is connected to a mouthpiece 70 of the electronic smoking device 210 that is configured to be slidably pushed along the longitudinal direction of the electronic smoking device 210.

Alternatively, as shown in FIG. 6B with respect to an embodiment in which a top-coil system cartomizer is provided, movement of the piston 60 into the cylindrical hollow body 141 can be achieved by pulling a respective mouthpiece 170 in direction of the arrow indicated in the figure. The mouthpiece 170 is configured to be slidably pulled along the longitudinal direction of the electronic smoking device 310 and is connected to the piston 60.

Further alternatively, and not shown in the figures, the piston 60 can be moved by means of a screw joint, which e.g. includes a rotatable dial that interlocks with a screw thread that is provided on the rod of the piston, wherein the rotatable dial can be operated by user of the electronic smoking device. The rotatable dial can be fixedly connected to a ratchet in such a manner that rotation of the dial in only that direction is possible that moves the piston into the cylindrical hollow body. In other words, the blocking unit can be connected with the dial so that the blocking unit according to FIG. 5 is dispensable.

In summary, in one aspect the electronic smoking device has a power supply, a liquid reservoir storing a liquid, and an atomizer. The atomizer is adapted to atomize the liquid stored in the liquid reservoir when operated by the power supply. The liquid reservoir comprises a first chamber storing the liquid, which first chamber has a variable volume that is reducible and non-increasable.

According to an embodiment, reduction of the volume of the first chamber can be controlled by a user of the electronic smoking device by operating a volume modifying unit of the electronic smoking device. The volume modifying unit can comprise a pressure source in order to directly or indirectly increase the pressure level in the first chamber.

According to an embodiment, the first chamber communicates with an outlet opening. The outlet opening can be arranged adjacent to the atomizer in order to supply liquid to the atomizer through the outlet opening.

According to an embodiment, the outlet opening is configured to let pass liquid when the pressure in the first chamber exceeds a predetermined threshold value.

According to an embodiment, the outlet opening communicates with a unidirectional valve, which e.g. prevents air entering into the first chamber.

According to an embodiment, the liquid reservoir comprises a piece of flexible material, which piece of flexible material at least partially defines the first chamber.

According to a first variant, the flexible material can be non-expandable. The piece can form a bladder that at least partially defines the first chamber. The electronic smoking device can then further comprise a squeezing unit that is configured to allow squeezing the bladder.

According to a second variant, the piece is formed as a sheet that is arranged inside the liquid reservoir in order to separate the first chamber from a second chamber of the liquid reservoir. In this case, the flexible material is preferably expandable.

According to an embodiment, the liquid reservoir comprises a fixed volume tank including the first chamber and a second chamber. The first chamber and the second chamber can be separated by the above-mentioned flexible sheet, which can be arranged in the tank. The electronic smoking device can include a volume modifying unit that is configured to increase the volume of the second chamber.

According an embodiment, the second chamber communicates with an inlet opening that is configured to let in a fluid into to second chamber. The inlet opening can be connected to a pressure source, so that e.g. pressurized fluid can be filled into the second chamber. The pressure source can be operated by a user of the electronic smoking device.

According to an embodiment, a unidirectional valve is arranged between the inlet opening and the pressure source. Thereby it can be ensured that no fluid can leave the second chamber.

According to an embodiment, the liquid reservoir comprises a rigid hollow cylindrical body including the first chamber, and a piston that is sealingly inserted into an open end of the hollow cylindrical body. The piston is configured to be moved into the hollow cylindrical body, thereby reducing the volume of the first chamber. The piston is mechanically connected with a blocking unit that is configured to prevent movement of the piston out of the cylindrical hollow body.

According to a second aspect, a liquid reservoir for an electronic smoking device or for an atomizer/liquid reservoir portion of an electronic smoking device or for a cartomizer of an electronic smoking device is provided. The liquid reservoir comprises a first chamber storing the liquid, which first chamber has a variable volume that is reducible and non-increasable.

Preferred embodiments of respective liquid reservoirs have already been described with respect to the electronic smoking device according to the first aspect.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 110, 210, 310 electronic smoking device
13 power supply portion
14 atomizer/liquid reservoir portion
16 end cap
18 battery
20 light-emitting diode (LED)
22 control electronics
24 airflow sensor
26 atomizer
28 heating coil
30 wick
32 air flow passage
34, 134, 234, 334 liquid reservoir
36 air inhalation port
38 air inlets
40 first chamber
41 rigid tank
42 second chamber
44 flexible expandable sheet
46 outlet opening
48 inlet opening
50, 56 valve
52 pressure source

54 liquid
58 flexible resilient portion
60 piston
62 blocking element
64 recess
66 stepped portion
70, 170 mouthpiece
141 hollow cylindrical body
144 flexible non-expandable bladder
146 rigid portion

The invention claimed is:

1. An electronic smoking device comprising:

a power supply;

a liquid reservoir configured for storing a liquid, wherein the liquid reservoir comprises a chamber for storing the liquid, and wherein the chamber has a variable volume that is reducible and non-increasable, wherein the liquid reservoir comprises a hollow cylindrical body including the first chamber;

a piston inserted into an open end of the hollow cylindrical body, wherein the piston is configured to be moved into the hollow cylindrical body to reduce the volume of the chamber, and wherein the piston is mechanically connected with a blocking unit that is configured to prevent movement of the piston out of the cylindrical hollow body, the blocking unit including a stepped portion on an inner wall of the cylindrical hollow body, wherein the step portion engages with a biased blocking element that protrudes from the piston; and an atomizer adapted to atomize the liquid stored in the liquid reservoir when operated by the power supply.

2. The electronic smoking device of claim 1, wherein the chamber communicates with an outlet opening.

3. The electronic smoking device of claim 2, wherein the outlet opening is configured to let pass liquid when the pressure in the chamber exceeds a predetermined threshold value.

4. The electronic smoking device of claim 2, wherein the outlet opening communicates with a unidirectional valve.

5. The electronic smoking device of claim 1, wherein the inlet opening is connected to a pressure source.

6. The electronic smoking device of claim 5, wherein a unidirectional valve is arranged between the inlet opening and the pressure source.

7. A liquid reservoir portion for an electronic smoking device, the liquid reservoir portion comprising:

a first chamber for storing the liquid, and wherein the first chamber has a variable volume that is reducible and non-increasable, and wherein, wherein the liquid reservoir comprises a hollow cylindrical body including the first chamber; and a piston inserted into an open end of the hollow cylindrical body, wherein the piston is configured to be moved into the hollow cylindrical body to reduce the volume of the first chamber, and wherein the piston is mechanically connected with a blocking unit that is configured to prevent movement of the piston out of the cylindrical hollow body, the blocking unit including a stepped portion on an inner wall of the cylindrical hollow body, wherein the step portion engages with a biased blocking element that protrudes from the piston.

8. The electronic smoking device of claim 1, wherein the fluid is a liquid.

9. The electronic smoking device of claim 1, wherein the bias blocking element is spring-biased to protrude from the piston.

10. The liquid reservoir portion of claim 7, wherein the bias blocking element is spring-biased to protrude from the piston.

* * * * *